US008608162B2

(12) United States Patent
Nakamura et al.

(10) Patent No.: US 8,608,162 B2
(45) Date of Patent: Dec. 17, 2013

(54) IMAGE FORMING APPARATUS

(75) Inventors: Kazutoshi Nakamura, Aichi (JP); Takashi Saito, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/434,175

(22) Filed: Mar. 29, 2012

(65) Prior Publication Data

US 2012/0274021 A1 Nov. 1, 2012

(30) Foreign Application Priority Data

Apr. 27, 2011 (JP) ..... 2011-099910

(51) Int. Cl.
*B65H 31/26* (2006.01)

(52) U.S. Cl.
USPC ..... 271/220; 271/221

(58) Field of Classification Search
CPC ..... B65H 31/36; B65H 31/26
USPC ..... 271/220
See application file for complete search history.

(56) References Cited

U.S. PATENT DOCUMENTS

| | | | | |
|---|---|---|---|---|
| 4,745,439 | A | 5/1988 | Hanada et al. | |
| 6,244,583 | B1 * | 6/2001 | Ohmichi et al. | 270/58.09 |
| 7,007,948 | B2 * | 3/2006 | Kamiya et al. | 271/221 |
| 7,475,876 | B2 * | 1/2009 | Kamiya et al. | 271/306 |
| 7,673,867 | B2 * | 3/2010 | Keny et al. | 270/58.12 |
| 7,677,557 | B2 * | 3/2010 | Ino | 271/220 |
| 8,200,145 | B2 * | 6/2012 | Kondo | 399/405 |
| 8,201,825 | B2 * | 6/2012 | Kamiya et al. | 271/306 |
| 2004/0201165 | A1 * | 10/2004 | Kamiya et al. | 271/220 |
| 2009/0214279 | A1 | 8/2009 | Ito | |
| 2011/0042890 | A1 * | 2/2011 | Lee et al. | 271/314 |
| 2012/0235349 | A1 * | 9/2012 | Yamaguchi | 271/220 |
| 2012/0242035 | A1 * | 9/2012 | Yoshida | 271/220 |

FOREIGN PATENT DOCUMENTS

| | | |
|---|---|---|
| JP | 62-008964 A | 1/1987 |
| JP | 11-079519 | 3/1999 |
| JP | 2001-270642 | 10/2001 |
| JP | 2003-081514 | 3/2003 |
| JP | 2005-239424 | 9/2005 |
| JP | 2007-106524 | 4/2007 |
| JP | 2007-112522 | 5/2007 |
| JP | 2007-112524 | 5/2007 |
| JP | 2007-217156 | 8/2007 |
| JP | 2009-202965 | 9/2009 |
| JP | 2011-001146 A | 1/2011 |

* cited by examiner

*Primary Examiner* — Kaitlin Joerger
(74) *Attorney, Agent, or Firm* — Banner & Witcoff, Ltd.

(57) ABSTRACT

An image forming apparatus including an image forming unit, a discharger, and a presser including a swingable member and a contact member is provided. The contact member is partially attached to the swingable member in a condition to create clearance between an unattached part and the swingable member. Weights of the contact member and the swingable member affect the sheet when the recording medium contacts the contact member and the contact member is moved to swing upward along with the swingable member by the recording medium. Resilient force is provided by the contact member to affect the recording medium when the recording medium contacts the contact member and the contact member is moved in a direction to narrow the clearance.

9 Claims, 4 Drawing Sheets

IMAGE FORMING APPARATUS

CROSS REFERENCE TO RELATED APPLICATION

This application claims priority from Japanese Patent Application No. 2011-099910, filed on Apr. 27, 2011, the entire subject matter of which is incorporated herein by reference.

BACKGROUND

1. Technical Field

An aspect of the present invention relates to an image forming apparatus.

2. Related Art

An image forming apparatus to form an image on a sheet of recording medium being conveyed in a conveyer path is known. The image forming apparatus may be equipped with a sheet suppressing flap, which suppresses the sheet being ejected downward, in order for the sheet to be discharged in a suitable area in a discharge tray.

The sheet suppressing flap may be configured to be swingable about a top end thereof and may be arranged in a vicinity of a discharge roller, which is rotated to eject the sheet. The sheet suppressing flap may deform the sheet downward by its weight as the sheet is conveyed by the discharge roller. In particular, the sheet suppressing flap may be pushed to swing up-frontward by a front end of the sheet being discharged and may forcibly flap a rear end of the sheet downward when the sheet is released from the discharge roller.

Whilst the sheet released from the discharge roller can be flapped downward by pressure from the weight of the sheet suppressing flap, a discharging path for a succeeding sheet can be cleared promptly, and it can avoid collision of a front end of the succeeding sheet with the rear end of the preceding sheet.

SUMMARY

Even with such a sheet suppressing flap, however, when the sheet is not flexible enough to be deformed by the sheet suppressing flap, the rear end of the sheet may not be directed downward.

For example, if the discharge tray is formed to upslope frontward along the sheet conveying direction, for example, and to have an upward convex cross-section, when taken along a line parallel with the sheet conveying direction, the sheet with flexibility may be deformed rather easily in arc to fit the upward convex of the discharge tray. If the sheet is rather rigid, on the other hand, the sheet may not easily be flexed. Further, if the sheet is curled with respect to a direction in parallel with the front and rear ends of the sheet, it may be even more difficult for the sheet to deform to fit the upward convex.

When the sheet remaining on the discharge tray has not been deformed, the sheet may be held by the upward curvature of the discharge tray at an area in a vicinity of a gravity center. In this regard, a rear part of the sheet which includes the rear end may float in the air from the surface of the discharge tray. When the rear part floats, if the pressure from the sheet suppressing flap is not high enough, the rear end of the sheet may not be suppressed downwardly. Therefore, it may not be avoided that the succeeding sheet collides with the preceding sheet. If the sheets collide, the sheets may be disordered or scattered in the discharge tray.

In order for the rigid sheet to be flapped downward, the sheet suppressing flap may be formed to provide higher pressure. With the sheet suppressing flap providing the higher pressure, however, when the flexible sheet is used, the sheet may not be rigid enough to push the sheet suppressing flap to swing up-frontward. Thus, the sheet may collide with the sheet suppressing flap and may be undesirably bent or wrinkled. In other words, the sheet suppressing flap may interrupt the sheet from discharged or may damage the sheet.

Thus, these problems due to the sheet suppressing flap can occur regardless of the flexibility or rigidity of the sheet even if the pressure from the sheet suppressing flap is adjusted to be lower or higher, and it has been difficult to effectively control the problems.

In consideration of the difficulty, the present invention is advantageous in that an image forming apparatus, which can discharge the sheet preferably in the discharge tray regardless of the flexibility or rigidity of the sheet, is provided.

According to an aspect of the present invention, an image forming apparatus is provided. The image forming apparatus an image forming unit configured to form an image on a sheet of recording medium, a discharger configured to discharge the recording medium with the image formed thereon by the image forming unit in a discharge tray, and a presser configured to contact the recording medium being discharged in the discharge tray by the discharger and to press the recording medium downward. The presser includes a swingable member configured to swing about a swing axis provided in an upper position with respect to a contact point, in which the discharger and the recording medium contact each other, and a contact member configured to contact the recording medium when the recording medium is discharged in the discharge tray by the discharger. The contact member is partially attached to the swingable member with clearance reserved between an unattached part of the contact member and the swingable member. Weights of the contact member and the swingable member affect the sheet when the recording medium being discharged in the discharge tray contacts the contact member and the contact member is moved to swing upward with the swingable member by the recording medium being discharged. Resilient force is provided from the contact member to affect the recording medium when the recording medium being discharged in the discharge tray contacts the contact member, and the contact member affected by the resilient force is moved in a direction to narrow the clearance.

BRIEF DESCRIPTION OF THE ACCOMPANYING DRAWINGS

DETAILED DESCRIPTION

Figure 1:
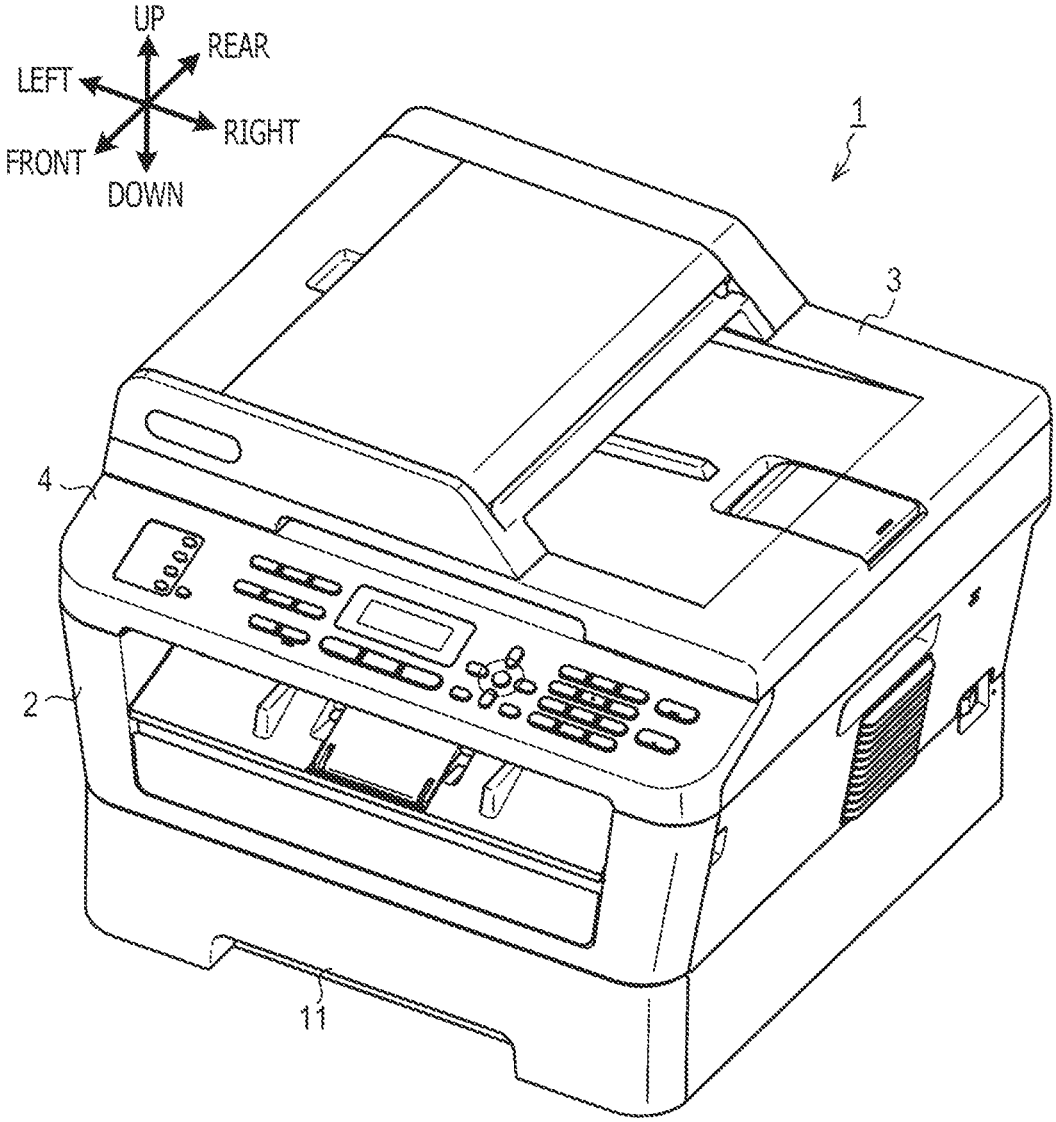
FIG. 1 is a perspective view of a multifunction peripheral device (MFP) according to an embodiment of the present invention.

Hereinafter, an embodiment of the present invention will be described with reference to the accompanying drawings. In the description provided below, directions concerning an MFP 1 according to the embodiment will be referred to based on a user's position to ordinarily use the MFP 1 and in accordance with orientation indicated by arrows in FIGS. 1-3. That is, for example, a viewer's lower-left side appearing in FIG. 1 is referred to as a front side of the MFP 1. An upper-right side in FIG. 1 opposite from the front is referred to as rear. A side, which corresponds to the viewer's upper-left side, is referred to as a left-side face and an opposite side from the left, which corresponds to the viewer's lower-right side, is referred to as a right-side face. The right-left direction of the MFP 1 may also be referred to as a crosswise direction. The up-down direction in FIG. 1 corresponds to a vertical direction of the MFP 1.

Overall Configuration of the MFP

The MFP 1 is equipped with a plurality of functions, which includes an image forming function, an image reading function, and a communicating function.

In order to achieve the plurality of functions, the MFP 1 includes a printer unit 2, a scanner unit 3, and an operation unit 4. The scanner unit 3 is arranged in an upper position with respect to the printer unit 2, and the operation unit 4 is arranged in an upper position with respect to the printer unit 2 and in a frontward position with respect to the scanner unit 3. The scanner unit 3 includes a flatbed-typed image scanner (unsigned) with an automatic document feeder (ADF) (unsigned) on top of the image scanner.

Figure 2:
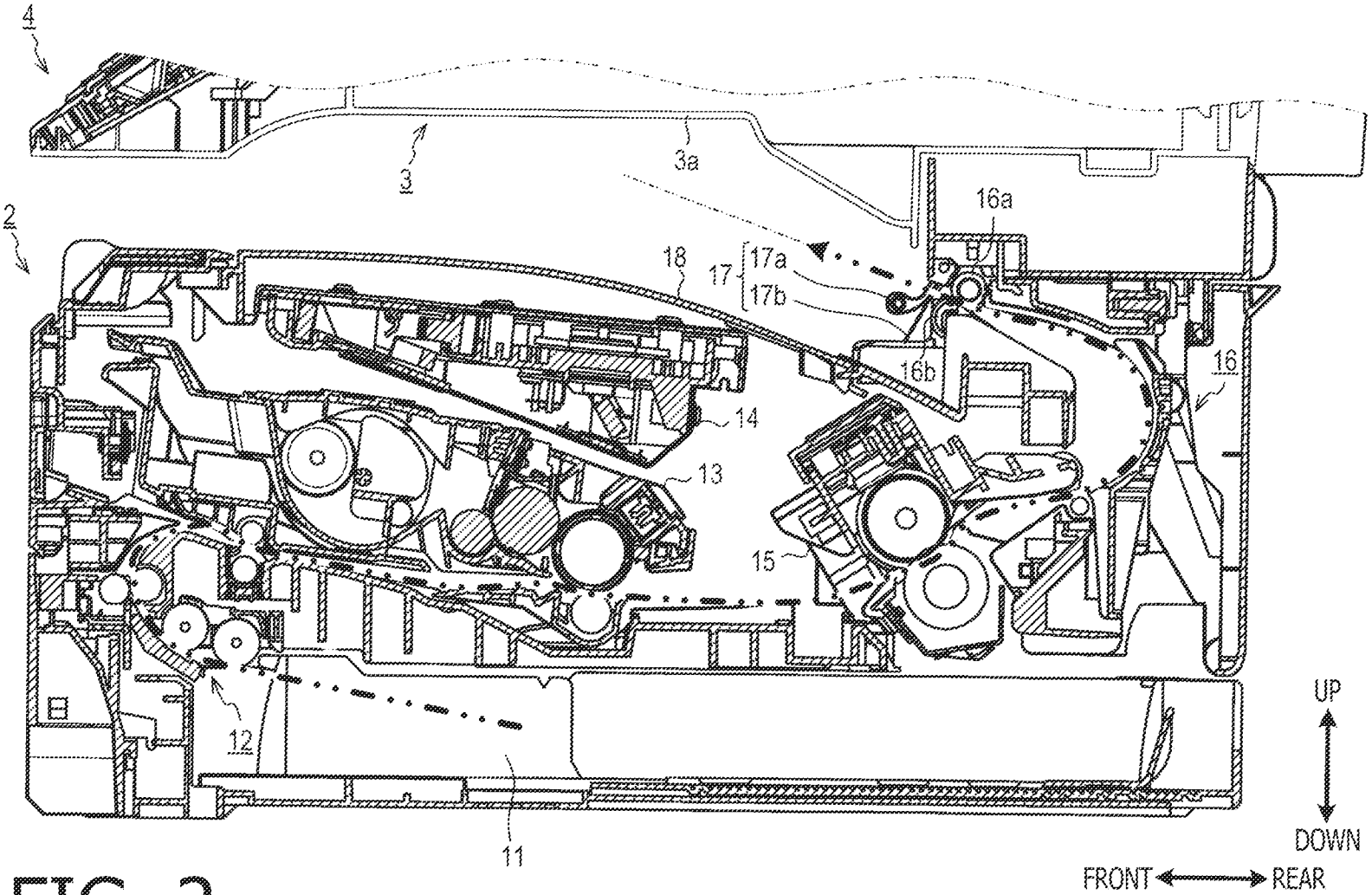
FIG. 2 is a cross-sectional side view of an image forming unit in the MFP according to the embodiment of the present invention.
Figure 3:
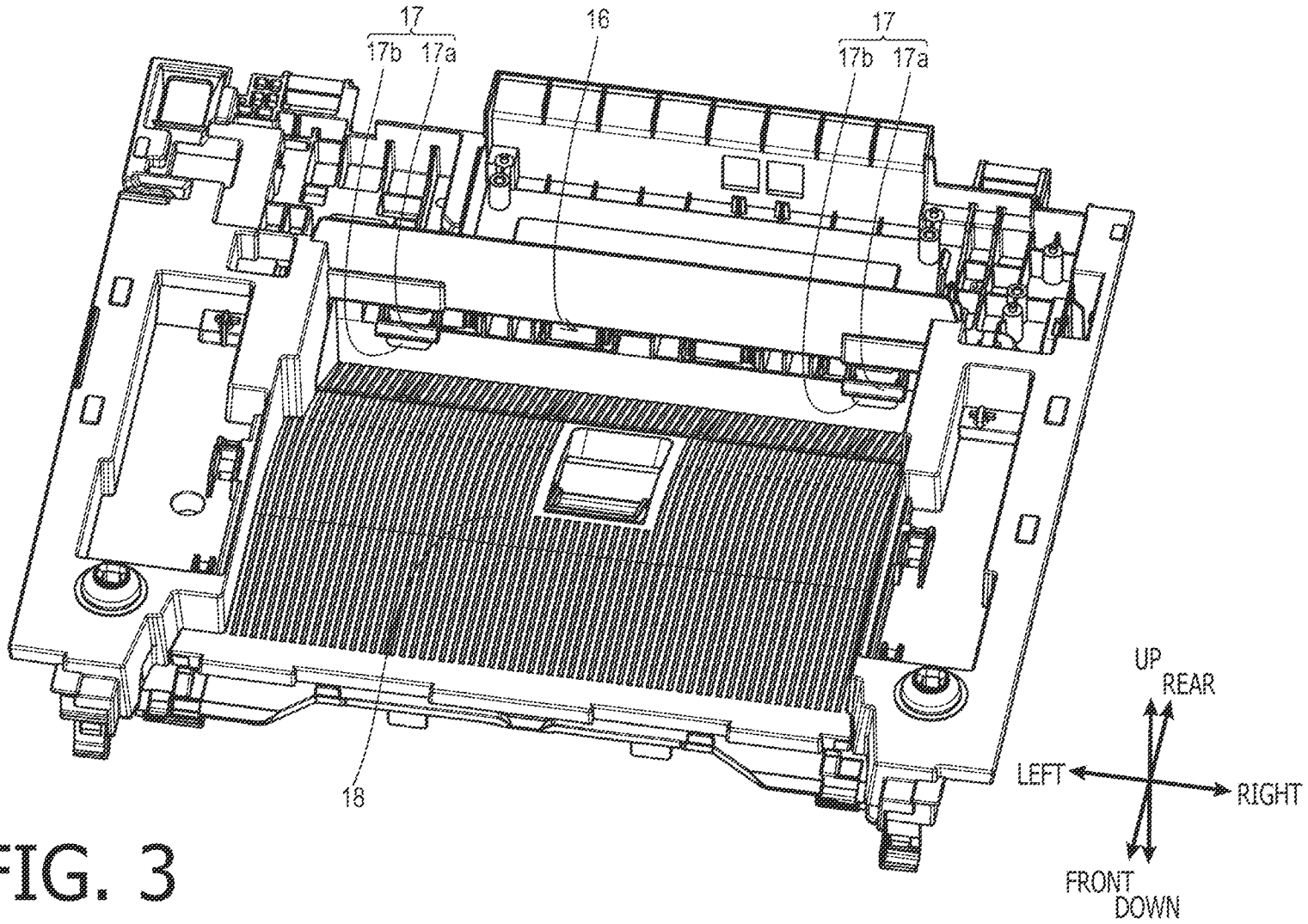
FIG. 3 is a perspective view of a discharge tray in the MFP according to the embodiment of the present invention.

The printer unit 2 includes, as shown in FIG. 2, a sheet cassette 11, a sheet conveyer 12, a processing cartridge 13, a laser scanner 14, a fixing unit 15, a discharger 16, and a sheet presser 17.

The sheet cassette 11 accommodates sheets of paper being recording medium and can be drawn in and out of the MFP 1 via the front face of the MFP 1. Thus, the sheet cassette 11 is removably installed in the MFP 1. The sheet conveyer 12 conveys the sheet from the sheet cassette 11 to a lower position with respect to the processing cartridge 13 in order for an image to be formed on a surface of the sheet.

The sheet conveyer 12 includes rollers, which rotate on the sheet to convey, and guides, which direct the sheet along a predetermined direction. Further, the sheet conveyer 12 includes a driving system (not shown), such as gears and cams, to transmit driving force from a drive source (not shown) to the rollers in the sheet conveyer 12.

The processing cartridge 13 includes a photosensitive member (unsigned) and a developer system (unsigned) to develop a latent image formed on the photosensitive member. The laser scanner 14 emits a laser beam to the photosensitive member in the processing cartridge 13 to form a latent image on a circumferential surface of the photosensitive member. The latent image formed on the photosensitive member is supplied with toner and developed to be a toner image by the developer system, and the toner image is transferred onto the surface of the sheet being conveyed. The fixing unit 15 nips the sheet with the transferred image in an intermediate nipping position between a pair of rollers and applies heat and pressure to the sheet. Thereby the transferred toner image is fixed thereat on the sheet.

The discharger 16 carries the sheet exiting the fixing unit 15 to a discharge tray 18, which is formed in a top part of the printer unit 2. The discharger 16 includes rollers to rotate on the sheet to carry and guides to direct the sheet being carried by the rollers along a predetermined direction. Further, the discharger 16 includes a driving system (not shown), such as gears and cams, to transmit driving force from a drive source (not shown) to the rollers in the discharger 16. The discharger 16 and the sheet conveyer 12 conveys the sheet in the printer unit 2 along a sheet conveying path, which is indicated by a double-dashed chain arrow indicated in FIG. 2.

The rollers in the discharger 16 include a discharge roller 16*a* and a nip roller 6*b*, which are arranged in vicinities of an end of the sheet conveying path. The sheet with the image formed thereon is nipped and discharged out of the printer unit 2 by rotation of the discharge roller 16*a* and the nip roller 16*b* and is released on the discharge tray 18.

An upper surface of the discharge tray 18 serves as a sheet discharge surface, on which the sheet discharged by the discharger 16 is settled. The sheet discharge surface is formed to upslope toward the front along the sheet feeding direction. The sheet discharge surface is formed to incline in a curve, which is moderate at a further side (i.e., the front side) further from the end of the sheet conveying path and acute at a nearer side (i.e., the rear side) nearer to the end of the sheet conveying path. Thus, the sheet discharge surface of the discharge tray 18 is formed in a cross-section of upward convex, when taken along a line parallel with the sheet conveying direction.

In a position above the discharge tray 18, a housing 3*a* serving as a casing for the scanner unit 3 is arranged. In the housing 3*a*, an image reader unit (not shown) to read an image from an original sheet is stored. The discharger 16 discharges the sheet in space formed between a bottom of the housing 3*a* and the discharge tray 18.

Configuration of the Sheet Presser

Figure 4A:
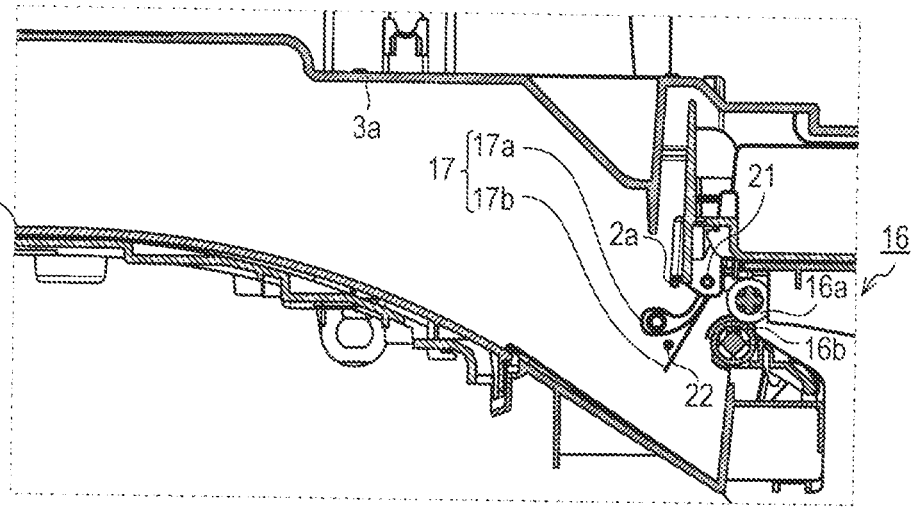
FIGS. 4A-4C are cross-sectional partial views of a sheet presser in the MFP according to the embodiment of the present invention.
Figure 4B:
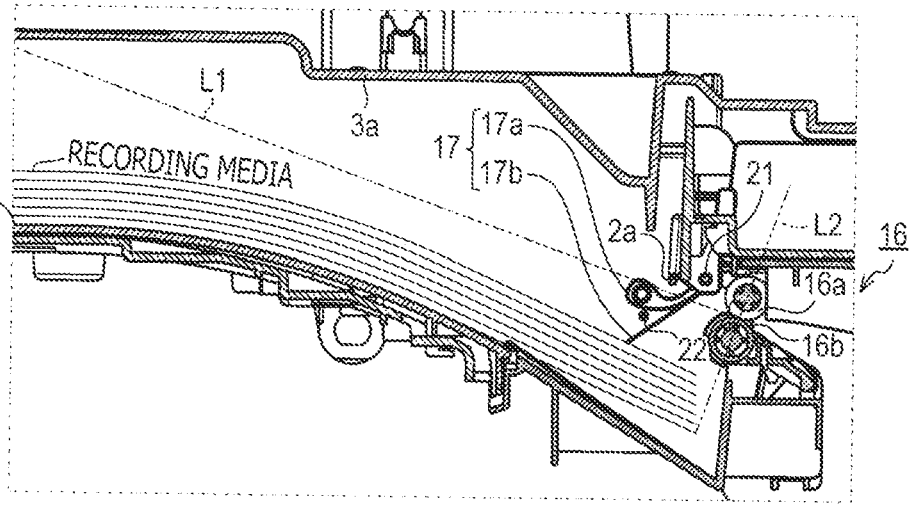
Figure 4C:
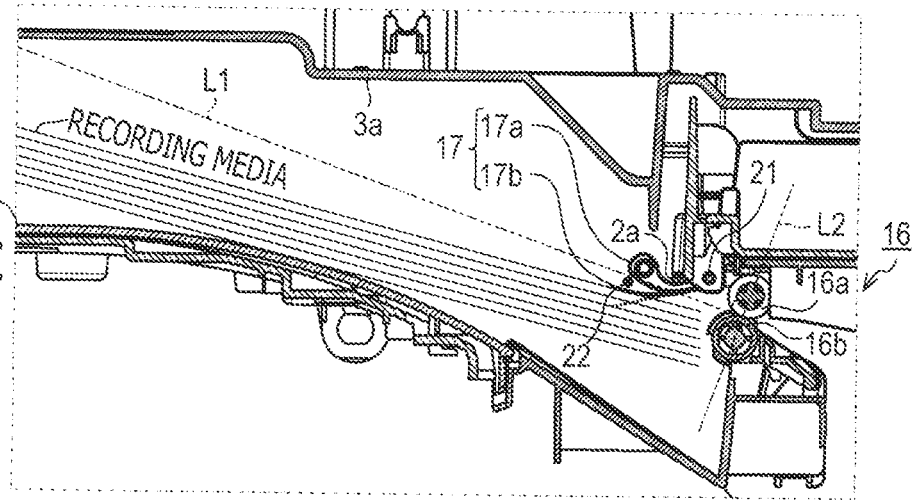

The sheet presser 17 suppresses the sheet being discharged by the discharger 16 in the discharge tray 18 downwardly and includes a swingable member 17*a* and a contact member 17*b* being a pair. In the present embodiment, two pairs of the swingable member 17*a* and the contact member 17*b* are arranged in positions spaced apart from each other along a direction of width of the sheet being conveyed. In the present embodiment, the direction of sheet-width corresponds to the right-left direction shown in FIG. 3 and is equivalent to the crosswise direction of the MFP 1. By the two pairs of the swingable members 17*a* and the contact members 17*b*, the sheet can be suppressed downwardly evenly at the positions in the vicinities of the widthwise ends thereof As shown in FIGS. 4A-4C, each of the swingable members 17*a* is swingable about a swing axis 21 within a swingable range, which is between a bottom dead center (see FIG. 4A) and a top dead center (see FIG. 4C). More specifically, a part of a housing 2*a* of the printer unit 2 is formed to have a shape to be in contact with the swingable member 17*a* when the swingable member 17*a* reaches one of the top dead center and the bottom dead center. Therefore, the swingable member 17*a* is restricted from swinging further beyond the housing 2*a*.

Each of the contact member 17*b* is made of a resilient material and serves as a deformable blade spring. In particular, in the present embodiment, the contact member 17*b* is a plastic film with specific flexibility and rigidity to serve as the blade spring. The contact member 17*b* is attached to the swingable member 17*a* at one end thereof In a position between an unattached part of the contact member 17*b*, which ranges between the attached end to an open end of the contact member 17*b*, and the swingable member 17*a*, clearance 22 is reserved when the swingable member 17 and the contact member 17*b* are in initial positions, i.e., when no sheet is in contact with the contact member 17*b* or no external force is applied (see FIG. 4A).

As shown in FIG. 4C, the contact member 17*b* is deformable in a direction to narrow the clearance 22. The deformed contact member 17*b* comes in a position to partially contact the swingable member 17*a* at the unattached part when the clearance 22 is narrowed to a predetermined amount. When the clearance 22 left in between the swingable member 17 and the contact member 17*b* is narrowed to the predetermined amount, the contact member 17*b* is restricted from being deformed further toward the swingable member 17*a*.

When the swingable member 17 and the contact member 17*b* are released from the external force (see FIG. 4A), the swingable member 17*a* is settled at the bottom dead center (i.e., the initial position) by the weight of the swingable member 17*a* itself Meanwhile, the contact member 17*b* follows the swingable member 17*a* to the bottom dead center without being deformed.

When the sheet is discharged by the discharger 16, the front end of the sheet contacts the contact member 17*b*. Accordingly, the contact member 17*b* is moved by the sheet along the sheet conveying direction. When the sheet is discharged further, the contact member 17*b* swings upward along with the swingable member 17*a*.

The swingable member 17*a* and the contact member 17*b* are configured such that weights of thereof are adjusted to allow the swingable member 17*a* and the contact member 17*b* to swing upward even by the contact with a rather flexible sheet. Therefore, when the flexible sheet contacts the contact member 17*b*, which is on a discharging path, the contact member 17*b* is uplifted by the pressure from the sheet being discharged to yield the discharging path to the sheet, and the swingable member 17*a* is also uplifted along with the contact member 17*b*. Therefore, the sheet can be prevented from being bent or stuck by the contact with the contact member 17*b*.

At the same time, the resiliency of the contact member 17*b* is adjusted to allow the contact member 17*b* to deform when greater pressure from a rigid sheet is applied thereto. Therefore, until the contact member 17*b* reaches the top dead center, the contact member 17*b* swings along with the swingable member 17*a* without being substantially deformed.

When the sheet being discharged by the discharger 16 is released from the discharge roller 16*a* and the nip roller 16*b*, the swingable member 17*a* and the contact member 17*b* swing downward by the weights thereof In this regard, the rear end of the sheet is forcibly flapped downward. Thus, the discharging path for a succeeding sheet is cleared. Therefore, when the succeeding sheet is discharged immediately after the preceding sheet being flapped, the front end of the succeeding sheet is prevented from colliding with the rear end of the preceding sheet.

When a plurality of flexible sheets are continuously discharged, as shown in FIG. 4B, the discharged sheets deform to fit the upward curvature of the sheet discharge surface in the discharge tray 18. Therefore, the rear ends of the flexible sheets can be easily cleared out of the discharging path by use of the weights of the swingable member 17*a* and the contact member 17*b*.

On the other hand, when a plurality of rigid sheets are continuously discharged, as shown in FIG. 4C, the sheets contact the discharge tray 18 at an area in a vicinity of a gravity center thereof In this regard, rear portions of the sheets, which are closer to the rear ends of the sheets, tend to float in the air. In particular, when the sheets are curled with respect to the direction of sheet width, the sheets may not be deformed easily along the sheet conveying direction against the curl, and it may be even more likely that the rear ends of the sheets float in the air.

When the sheets tend to float, the sheets may not be flapped downward effectively by the weights of the swingable member 17*a* and the contact member 17*b* alone, and the swingable member 17*a* may be moved to swing upward to reach the top dead center. When the swingable member 17*a* is at the top dead center, and the sheet being discharged applies further pressure to the contact member 17*a*, the contact member 17*b* deforms in a direction to be closer to the swingable member 17*a* from a position indicated by a broken line in FIG. 4C to a position indicated by a solid line.

In this regard, resilient force generated in the contact member 17*b* by the deformation suppresses the sheet downward. Therefore, the sheet is suppressed by the resilient force in the contact member 17*b* in addition to the weights of the swingable member 17*a* and the contact member 17*b*. Accordingly, the sheet is flapped downward by the greater force to a position lower than an imaginary line L1 (see FIGS. 4B and 4C), which coincides with a discharging direction of the sheet.

In the present embodiment, the imaginary line L1 coincident with the discharging direction of the sheet is a line, which is orthogonal with respect to an imaginary line L2, and which includes the nipping point between the discharge roller 16*a* and the nip roller 16*b*. The imaginary line L2 is a line, which includes rotation axes of the discharge roller 16*a* and the nip roller 16*b*.

In the MFP 1, without the sheet presser 17, it is assumed that the sheet would be conveyed in a direction along the imaginary line L1. Therefore, if the rear end of the discharged sheet is suppressed downward to the lower position than the imaginary line L1, the discharging path for the succeeding sheet is cleared, and the front end of the succeeding sheet is prevented from colliding with the rear end of the preceding sheet.

In particular, according to the present embodiment, even when the swingable member 17*a* is at the top dead center, as shown in FIG. 4C, a part of the swingable member 17*a* is in a lower position than the imaginary line L1. Therefore, the contact member 17*b*, which can be deformed at most to the position to contact the swingable member 17*a*, is steadily maintained in the lower position than the imaginary line L1 at least at the lowest part (i.e., at the open end). Accordingly, the rear end of the sheet can be steadily suppressed downward to the lower position than the imaginary line L1.

Effects

As has been described above, according to the MFP 1 in the present embodiment with the sheet presser 17, a condition, in which the weights of the swingable member 17*a* and the contact member 17*b* affect the sheet, and a condition, in which the resilient force in the contact member 17*b* in addition to the weights of the swingable member 17*a* and the contact member 17*b* affects the sheet, can be created depending on the flexibility or rigidity of the sheet being discharged.

Therefore, when a flexible sheet is discharged, the sheet presser 17 can have the swingable member 17*a* and the contact member 17*b* to flap the sheet by their weights alone whilst the contact member 17*b* is prevented from being deformed and whilst the sheet is prevented from being affected by excessive force. Accordingly, the sheet being discharged can be prevented from being colliding with the contact member 17*b* and from being damaged.

On the other hand, when the rigid sheet is discharged, the sheet presser 17 can have the resilient force in the contact member 17*b* and have the weights of the swingable member 17*a* and the contact member 17*b* to apply the downward flapping pressure to the sheet. Accordingly, the rear end of the rigid sheet can be suppressed downward steadily, and the sheet being discharged can be prevented from being collided by a succeeding sheet and from being scattered disorderly in the discharge tray 18.

According to the MFP 1 in the present embodiment, the contact member 17*b* is a piece of plastic film, which is formed to serve as a resiliently deformable blade spring. Therefore, another resilient member, which is separately formed from the contact member to provide resiliency, is not necessary. Therefore, a quantity of pieces in the MFP 1 and manufacturing processes can be reduced.

According to the MFP 1 in the present embodiment, a part of the housing 2*a* of the printer unit 2 serves to restrict the swinging behavior of the swingable member 17*a*. More specifically, the swingable member 17*a* is restricted from swinging further beyond the housing 2*a*. Therefore, when the rigid sheet moves the swingable member 17*a* to swing upward, the swingable member 17*a* restricted by the housing 2*a* can suppress the sheet effectively without being moved further beyond the housing 2*a*.

According to the MFP 1 in the present embodiment, the swingable member 17*a* becomes partially in contact with the contact member 17*b* when the contact member 17*b* moves in the direction to narrow the clearance 22 for a predetermined amount. In other words, the contact member 17*b* is restricted by the swingable member 17*a* from being moved further upward beyond the point, in which the contact member 17*b* comes in contact with the swingable member 17*b*. Thus, even when the rigid sheet pushes the contact member 17*b* upward, the restricted contact member 17*b* can effectively suppress the sheet downward.

According to the MFP 1 in the present embodiment, the swingable member 17*a* swings upward, and once the swingable member 17 a reaches the top dead center, the contact member 17*b* moves in the direction to narrow the clearance 22. Therefore, when the flexible sheet is discharged, the sheet presser 17 can have the swingable member 17*a* and the contact member 17*b* to flap the sheet by their weights alone whilst the contact member 17*b* is prevented from being deformed and whilst the sheet is prevented from being affected by excessive force. Accordingly, the sheet being discharged can be prevented from being colliding with the contact member 17*b* and from being damaged. Meanwhile, when the rigid sheet is discharged, after the swingable member 17*a* reaches the top dead center, the sheet presser 17 can have the resilient force in the contact member 17*b*, and have the weights of the swingable member 17*a* and the contact member 17*b* to apply the downward flapping pressure to the sheet. Accordingly, the rear end of the rigid sheet can be directed downward steadily, and the sheet being discharged can be prevented from being collided by a succeeding sheet and from being scattered disorderly in the discharge tray 18.

According to the MFP 1 in the present embodiment, the sheet presser 17 can suppress the sheet at each widthwise end position. Therefore, the widthwise edges of the sheet can be suppressed equivalently, and a plurality of sheets can be stacked in a balanced condition in the discharge tray 18 stably.

According to the MFP 1 in the present embodiment, although the discharger 16 may discharge the sheets in the rather small space between the bottom of the housing 3*a* and the discharge tray 18, with the sheet presser 17 suppressing the sheets effectively, a larger amount of the sheets may be orderly stacked in the discharge tray 18.

According to the MFP 1 in the present embodiment, the contact member 17*b* contacts the sheet at the position lower than the imaginary line L1, which coincides with the discharging direction for the sheet being discharged and includes the nipped point between the discharge roller 16*a* and the nip roller 16*b*, when the contact member 17*b* is at the uppermost deformable position. When the sheet with rigidity is discharged without being deformed, even if the contact member 17*b* is at the uppermost deformable position, the contact member 17*b* contacts the sheet at the position lower than the imaginary line L1. Therefore, the sheet can be maintained preferably at the position lower than the imaginary line L1 without having the rear end floating in the air.

More Examples

Although an example of carrying out the invention has been described, those skilled in the art will appreciate that there are numerous variations and permutations of the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, in the above-described embodiment, once the swingable member 17*a* is moved to reach the top dead center, the contact member 17*b* starts being deformed thereafter. However, the order of deforming behaviors may not necessarily be limited to those described above. More specifically, the contact member 17*b* may be deformed to narrow the clearance 22 between the swingable member 17*a* and the contact member 17*b* prior to deformation of the swingable member 17*a*. Once the deformed contact member 17*b* reaches the swingable member 17*a*, the swingable member 17*a* may be moved to the top dead center thereafter. In other words, the balance between the weights of the swingable member 17*a* and the contact member 17*b* and the resiliency (i.e., the constant of spring) of the contact member 17*b* may be inversed from those in the above-described embodiment.

For example, the contact member 17*b* may not necessarily be made of the resilient material formed in the shape of blade spring. The contact member 17*b* may be made of a rigid material, and an additional resilient member may be interposed between the rigid contact member and the swingable member 17*a*.

For another example, a contact member, which can swing about an open end of the swingable member, may be attached to the swingable member, and a spring may be interposed between the swingable member and the contact member. Thus, the contact member may be resiliently supported by the swingable member.

For another example, in the above-describe embodiment, the swingable member 17*a* and the contact member 17*b* are at least partially in the positions lower than the imaginary line L1 when the swingable member 17*a* and the contact member 17*b* are in the uppermost deformable positions. However, as long as the contact member 17*b* contacts the sheet at least partially at the position lower than the imaginary line L1, the swingable member 17*a* may or may not be in the position lower than the imaginary line L1.

For another example, the image forming apparatus may not necessarily be an image forming apparatus to form an image in the electrophotographic method but may form an image in other methods, which include, for example, inkjet printing and thermal transfer printing.

What is claimed is:

1. An image forming apparatus, comprising:

an image forming unit configured to form an image on a sheet of a recording medium;

a discharger configured to discharge the recording medium with the image formed thereon by the image forming unit to a discharge tray; and a presser configured to contact the recording medium being discharged to the discharge tray by the discharger and to press the recording medium downward, wherein the presser comprises:

a swingable member configured to swing about a swing axis provided in an upper position with respect to a contact point, in which the discharger and the recording medium contact each other; and a contact member configured to contact the recording medium when the recording medium is discharged to the discharge tray by the discharger;

wherein the contact member is partially attached to the swingable member with clearance reserved between an unattached part of the contact member and the swingable member;

wherein weights of the contact member and the swingable member affect the sheet when the recording medium being discharged to the discharge tray contacts the contact member and the contact member is moved along with the swingable member to swing upward by the recording medium being discharged; and wherein resilient force is provided from the contact member to affect the recording medium when the recording medium being discharged to the discharge tray contacts the contact member, and the contact member affected by the resilient force is moved in a direction to narrow the clearance.

2. The image forming apparatus according to claim 1, wherein the contact member is fixed to the swingable member at one end; and wherein the contact member includes a resilient blade spring, which forms the clearance in a position between the unattached part ranging from the fixed one end and the other open end of the contact member and the swingable member.

3. The image forming apparatus according to claim 1, further comprising:

a swing restrictive member configured to contact the swingable member, when the swingable member is moved to swing upward to reach a predetermined uppermost position, to restrict the swingable member from being moved further upward beyond the uppermost position.

4. The image forming apparatus according to claim 1, wherein the swingable member contacts the contact member, when the contact member is moved in the direction to narrow the clearance and reaches a restrictive position, to restrict the contact member from being moved further in the narrowing direction beyond the restrictive position.

5. The image forming apparatus according to claim 1, further comprising:

a swing restrictive member configured to contact the swingable member, when the swingable member is moved to swing upward to reach a predetermined uppermost position, to restrict the swingable member from being moved further upward beyond the uppermost position, wherein the swingable member contacts the contact member, when the contact member is moved in the direction to narrow the clearance and reaches a restrictive position, to restrict the contact member from being moved further in the narrowing direction beyond the restrictive position; and wherein, when the recording medium being discharged in the discharge tray by the discharger contacts the contact member, at least the swingable member swings until the swingable member reaches the uppermost position, and the contact member is moved in the direction to narrow the clearance after the swingable member reaches the uppermost position.

6. The image forming apparatus according to claim 1, wherein the presser includes a plurality of pressers, which are arranged in separate positions apart from each other along a widthwise direction of the recording medium to press widthwise end positions of the recording medium.

7. The image forming apparatus according to claim 1, wherein a housing to accommodate an image reading unit is arranged in an upper position with respect to the discharge tray; and wherein the discharger discharges the recording medium in space created in between a bottom of the housing and the discharge tray.

8. The image forming apparatus according to claim 1, wherein the discharger comprises a pair of rollers, which are configured to nip the recording medium in a nipping position between the rollers and rotate with the recording medium nipped in the nipping position; and wherein the contact member contacts the recording medium at a position lower than an imaginary line, which coincides with a discharging direction of the recording medium and includes the nipping position, when the contact member is at an uppermost position within a swingable range.

9. The image forming apparatus according to claim 1, wherein the contact member is made of a resilient material.

* * * * *